US007380660B2

(12) United States Patent
Lin

(10) Patent No.: US 7,380,660 B2
(45) Date of Patent: Jun. 3, 2008

(54) TOOL HANDLE TYPE TOOL BOX

(75) Inventor: Hung-Lin Lin, Changhua (TW)

(73) Assignee: Witman Corporation, Changhua (TW)

( * ) Notice: Subject to any disclaimer, the term of this patent is extended or adjusted under 35 U.S.C. 154(b) by 275 days.

(21) Appl. No.: 11/261,460

(22) Filed: Oct. 31, 2005

(65) Prior Publication Data

US 2007/0095691 A1 May 3, 2007

(51) Int. Cl.
*B65D 85/00* (2006.01)
*B25B 23/16* (2006.01)
*B25G 1/08* (2006.01)

(52) U.S. Cl. ..... 206/375; 206/377; 206/378; 81/177.4; 81/490

(58) Field of Classification Search ..... 206/372–379; 81/177.4, 490; D8/83, 87, 105
See application file for complete search history.

(56) References Cited

U.S. PATENT DOCUMENTS

| | | | | |
|---|---|---|---|---|
| 5,566,596 | A * | 10/1996 | Lin | 81/490 |
| 5,613,413 | A * | 3/1997 | Huang | 81/490 |
| 5,704,260 | A * | 1/1998 | Huang | 81/177.4 |
| 5,782,150 | A * | 7/1998 | Huang | 81/177.4 |
| 5,918,513 | A * | 7/1999 | Ho | 81/490 |
| 6,243,902 | B1 * | 6/2001 | Huang | 81/177.4 |
| 6,314,600 | B1 * | 11/2001 | Cachot | 81/490 |
| 6,431,034 | B1 * | 8/2002 | Chen | 81/177.4 |

* cited by examiner

*Primary Examiner*—J. Gregory Pickett
(74) *Attorney, Agent, or Firm*—Rosenberg, Klein & Lee

(57) ABSTRACT

A tool handle type tool box, which includes a first cover shell, which has a connector at one end and hexagonal coupling holes formed in the connector for the mounting of a tool bit adapter to hold a tool bit for working, a second cover shell, which forms with the first cover shell a grip and has a tool bit tray detachably set therein for holding tool bits and two C-shaped coupling rings disposed at one end and pivotally coupled to the connector of the first cover shell.

1 Claim, 3 Drawing Sheets

TOOL HANDLE TYPE TOOL BOX

BACKGROUND OF THE INVENTION

1. Field of the Invention

The present invention relates to a tool box for holding tool bits and other accessories and more particularly, to a tool handle type tool box that is made is the form of a tool handle.

2. Description of the Related Art

Conventional tool boxes may be made in any of a variety of forms for holding different tool parts and accessories. These tool boxes are specifically designed for holding tool parts and accessories, not usable for other purposes.

SUMMARY OF THE INVENTION

The present invention has been accomplished under the circumstances in view. It is the main object of the present invention to provide a tool box, which can be used as a tool box for holding tool parts and accessories as well as a tool handle to hold a tool bit adapter and a tool bit for working. To achieve this and other objects of the present invention, the tool handle type tool box comprises a first cover shell, which has a connector at one end and hexagonal coupling holes formed in the connector for the mounting of a tool bit adapter to hold a tool bit for working, a second cover shell, which forms with the first cover shell a grip and has a tool bit tray detachably set therein for holding tool bits and two C-shaped coupling rings disposed at one end and pivotally coupled to the connector of the first cover shell.

DETAILED DESCRIPTION OF THE PREFERRED EMBODIMENT

Figure 1:
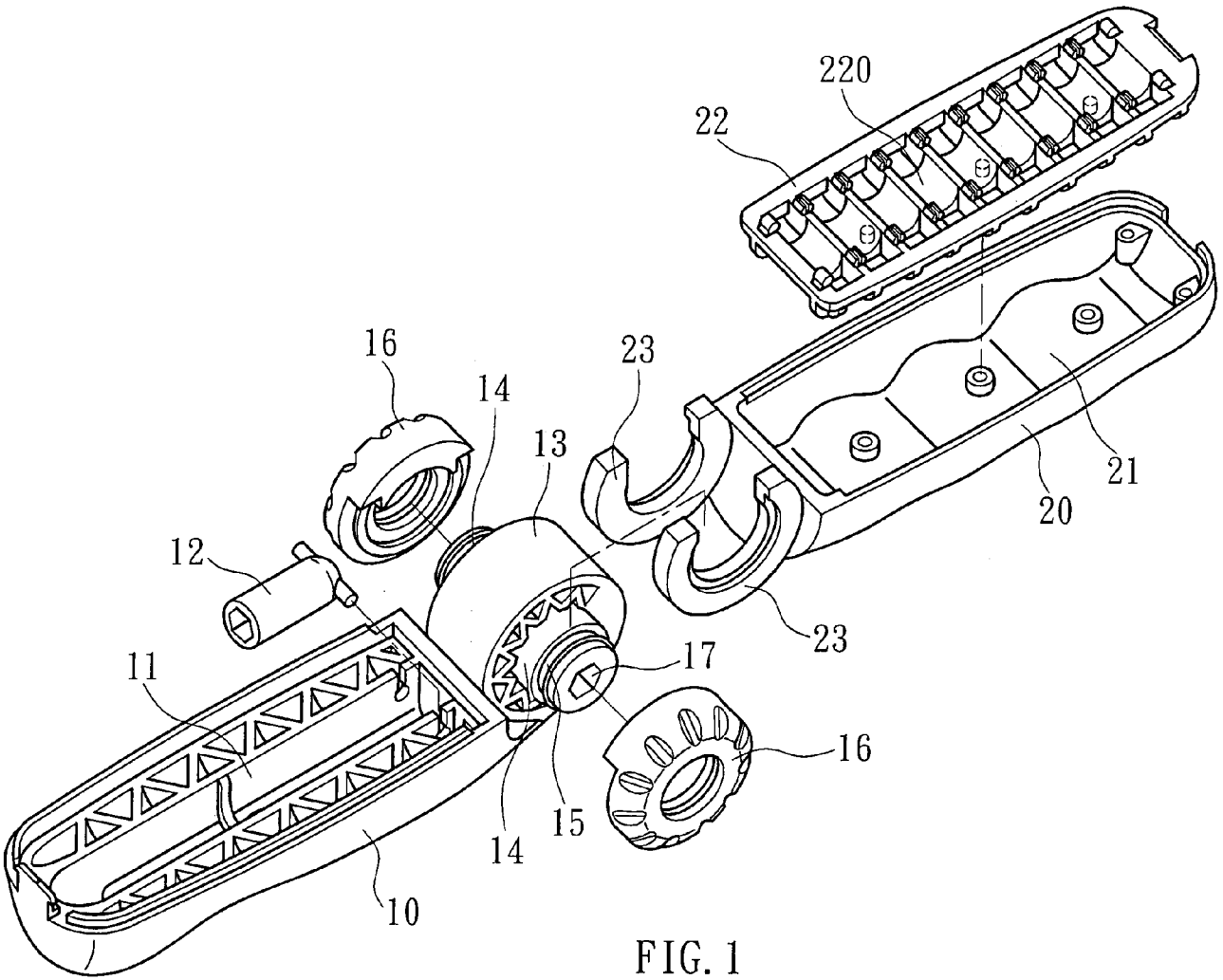
FIG. 1 is an exploded view of a tool handle type tool box according to the present invention.
Figure 2:
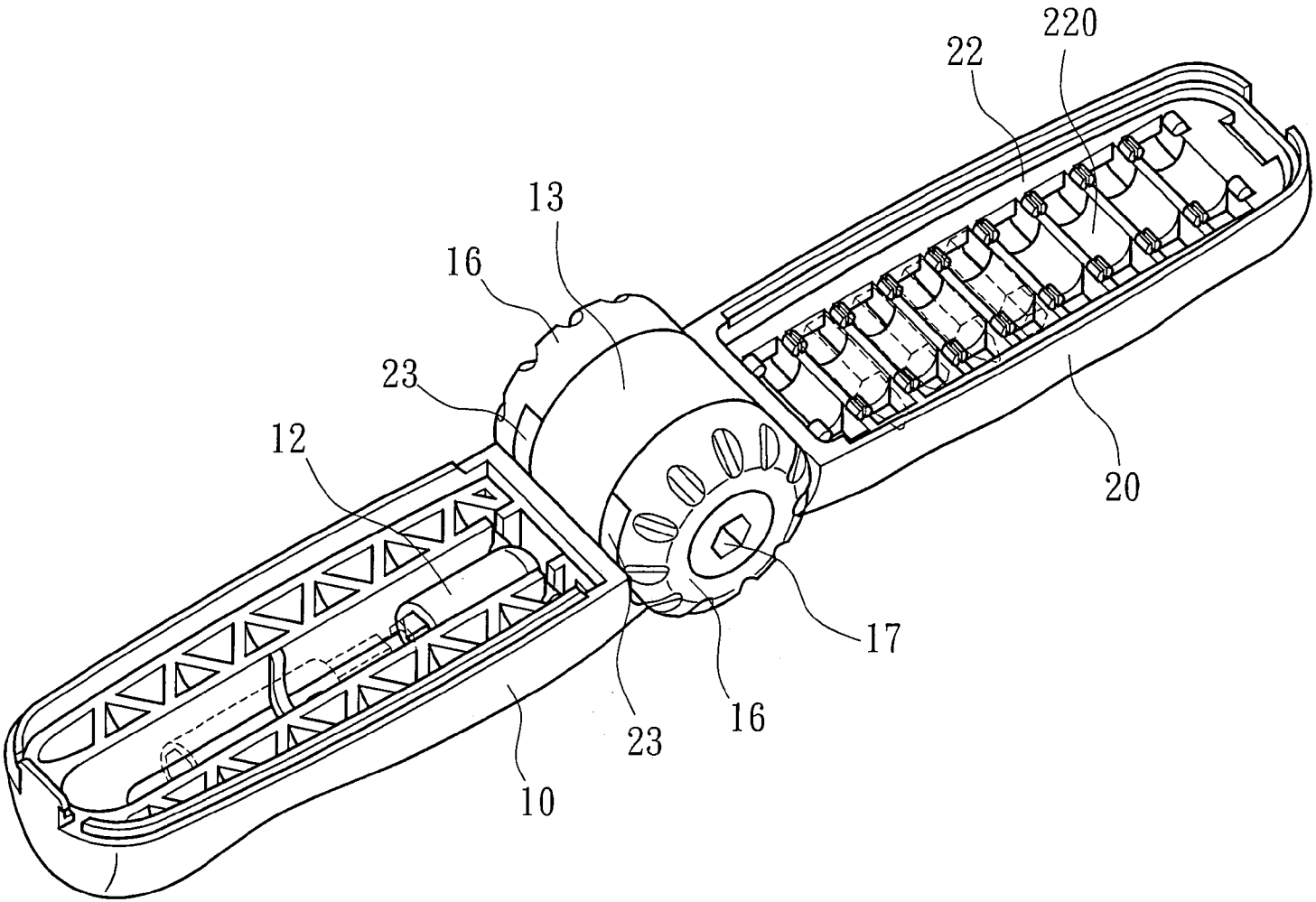
FIG. 2 is an elevational assembly view of the present invention, showing the open status of the tool handle.

Referring to FIGS. 1 and 2, a tool handle type tool box in accordance with the present invention is shown comprising a first cover shell 10 and a second cover shell 20.

The first cover shell 10 is a narrow elongated shell having a connector 13 fixedly provided at one end, and a longitudinal groove 11. A tool bit socket 12 is pivotally mounted in the longitudinal groove 11. The connector 13 is shaped like a barrel, having a hexagonal coupling hole 18 in the peripheral wall and two pivot rods 14 aligned at two sides. The pivot rods 14 each have a coupling groove 15 extending around the periphery and a hexagonal coupling hole 17 formed in the free end.

The second cover shell 20 is a narrow elongated shell fitting the first cover shell 10, having two C-shaped coupling rings 23 fixedly provided at one end and respectively pivotally coupled to the pivot rods 14 of the connector 13 of the first cover shell 10, a receiving open chamber 21, and a tool bit tray 22 detachably set in the receiving open chamber 21. The tool bit tray 22 has a set of tool bit grooves 220 for holding tool bits. Further, two end caps 16 are respectively fastened to the coupling grooves 15 of the pivot rods 14 of the connector 13 of the first cover shell 10 to secure the C-shaped coupling rings 23 to the pivot rods 14 of the connector 13 of the first cover shell 10, preventing disconnection of the second cover shell 20 from the first cover shell 10.

Figure 3A:
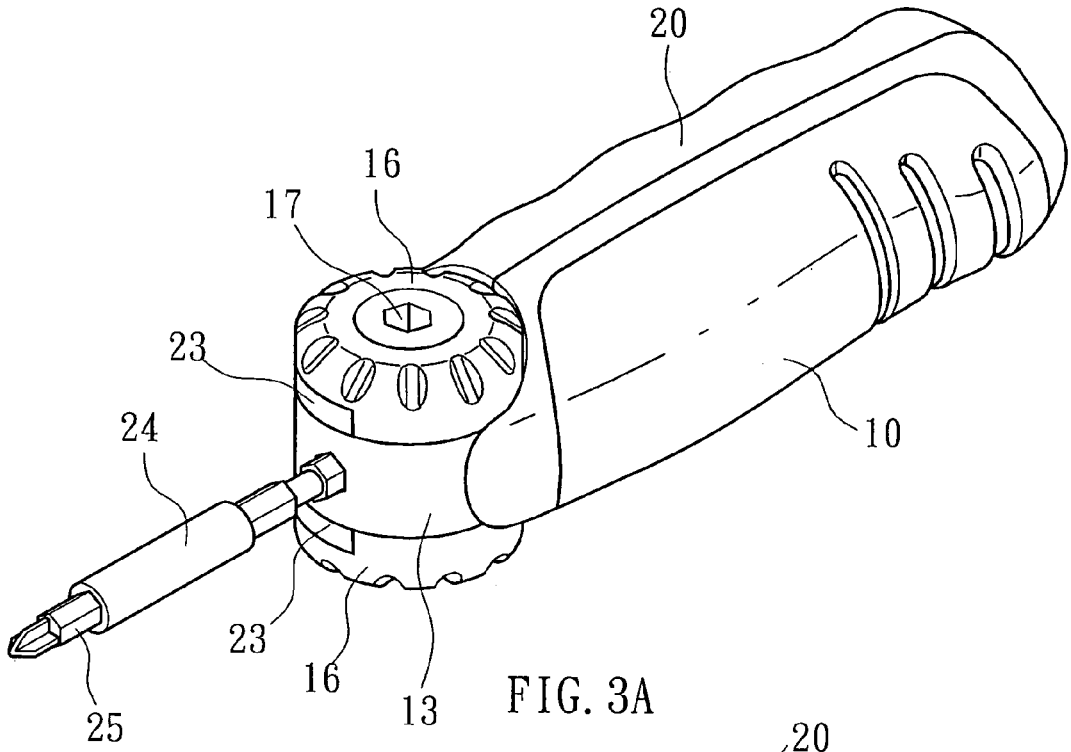
FIG. 3A shows an application example of the tool handle type tool box according to the present invention.
Figure 3B:
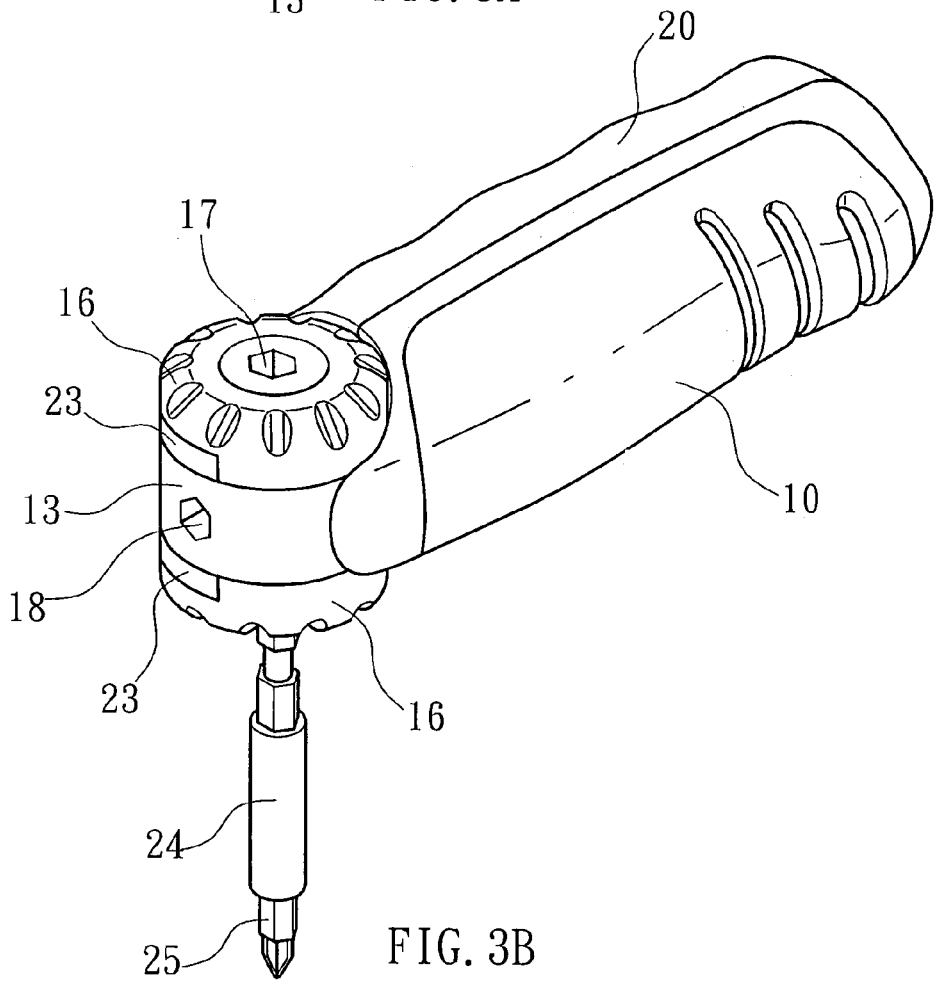
FIG. 3B shows another application example of the tool handle type tool box according to the present invention

Referring to FIGS. 3A and 3B, a tool bit adapter 24 can be attached to the hexagonal coupling hole 17 or 18 to hold a tool bit 25. Thus, the tool handle type tool box is used as a tool handle that forms with the tool bit adapter 24 and the attached tool bit 25 a hand tool.

Although a particular embodiment of the invention has been described in detail for purposes of illustration, various modifications and enhancements may be made without departing from the spirit and scope of the invention.

What the invention claimed is:

1. A tool box comprising:

a first cover shell sized to fit a user's hand, said first cover shell having a connector fixedly provided at one end thereof, and a longitudinal groove, said connector having a hexagonal coupling hole formed in the periphery thereof and two pivot rods aligned at two sides thereof, said pivot rods each having a coupling groove extending around the periphery thereof and a hexagonal coupling hole in a free end thereof;

a tool bit socket pivotally mounted in said longitudinal groove for holding a tool bit for working;

a second cover shell sized to fit a user's hand, and adapted to form with said first cover shell a grip, said second cover shell having two C-shaped coupling rings fixedly provided at one end thereof and respectively pivotally coupled to said pivot rods of said connector of said first cover shell, a receiving open chamber, and a tool bit tray detachably set in said receiving open chamber, said tool bit tray having a set of tool bit grooves for holding tool bits; and two end caps respectively fastened to said coupling grooves of said pivot rods of said connector of said first cover shell to secure said C-shaped coupling rings to said pivot.

* * * * *